US006113166A

United States Patent [19]

Wynn

[11] Patent Number: 6,113,166

[45] Date of Patent: Sep. 5, 2000

[54] SANITARY PICKUP APPARATUS FOR ANIMAL FECES

[76] Inventor: David S. Wynn, 1901 Fountain View, Edmond, Okla. 73013

[21] Appl. No.: 09/464,102

[22] Filed: Dec. 16, 1999

Related U.S. Application Data

[60] Provisional application No. 60/117,259, Jan. 26, 1999.

[51] Int. Cl.[7] ..... A01K 29/00; E01H 1/12

[52] U.S. Cl. ..... 294/1.4; 15/104.8; 15/257.7

[58] Field of Search ..... 294/1.3–1.5, 19.2, 294/55; 15/104.8, 257.1–257.4, 257.6, 257.7, 79.1, 83; 56/327.1, 328.1, 332, 400.02, 400.11, 400.13

[56] References Cited

U.S. PATENT DOCUMENTS

| | | | |
|---|---|---|---|
| 3,052,214 | 9/1962 | Johnson | 294/1.4 |
| 3,757,737 | 9/1973 | Drum et al. | 294/1.4 |
| 3,937,509 | 2/1976 | Hufnagel | 294/1.4 |
| 4,102,547 | 7/1978 | Williams | 294/1.3 |
| 4,200,321 | 4/1980 | Warkentin | 294/1.4 |
| 4,210,351 | 7/1980 | Orofino | 294/1.4 |
| 4,360,229 | 11/1982 | Kinney | 294/1.4 |
| 4,741,566 | 5/1988 | Byung-Do et al. | 294/1.4 |
| 4,966,400 | 10/1990 | Hull et al. | 294/1.4 |
| 5,269,575 | 12/1993 | Parvaresh | 294/1.5 |
| 5,320,393 | 6/1994 | Coritnas | 294/1.4 |
| 5,667,264 | 9/1997 | Tanahara | 294/1.4 |

*Primary Examiner*—Johnny D. Cherry
*Attorney, Agent, or Firm*—Robert K. Rhea

[57] ABSTRACT

A mechanical apparatus for sequentially loading multiple quantities of articles or animal droppings from the surface of the earth into a disposable bag or receptacle is formed by an upright open frame assembly vertically supporting a telescoping handle member. Upon downward telescoping movement of the handle, with the frame assembly supported by the surface of the earth, a panel sweep assembly is vertically pivoted about a horizontal axis to propel articles on the surface of the earth into the open end of a receptacle, adjacent and attached to the frame assembly. The receptacle is removable to dispose of the articles therein.

14 Claims, 3 Drawing Sheets

70
72
58
32

47
49

42
45
5
44
5
46
86
84
93
74
92
40
33
21
22
76
24
28
92
76
28
91
94
52
26
91
30
90
36
31
6
58
32
38
90
78
82
51
70
82
64
34
63
80
59
16
61
60
50
50
48

SANITARY PICKUP APPARATUS FOR ANIMAL FECES

This application claims the benefit of U.S. Provisional application Ser. No. 60/117,259, filed Jan. 26, 1999.

CROSS REFERENCE TO RELATED APPLICATION

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to article pickup devices and more particularly to a device for sanitary release of animal feces collected in a bag.

Many municipalities have laws and ordinances requiring animal owners to remove feces left by their animals on public and private property. Animal owners often desire to pick up animal droppings from an area where an animal is confined. Such removal requires the animal owner to pick up the feces and transport it to a suitable place of disposal.

2. Description of Related Art Including Information Disclosed Under 37CFR 1.97 and 1.98

The most relevant prior art known to applicant include U.S. Pat. No. 3,757,737, issued Sep. 11, 1973, to Drum et al, U.S. Pat. No. 5,320,393, issued Jun. 14, 1994 to Cortinas, and U.S. Pat. No. 5,667,264, issued Sep. 16, 1997 to Tanahara.

The Drum etal patent discloses an elongated handle having a bag supporting frame and an article pick up member pivotally joined to the depending end of the handle which is actuated by the user moving a lever pivoted to the handle to force the pick up member to move feces in a bag.

Both the Cortinas and Tanahara patents disclose an upright handle member having a frame supporting a bag or container at its depending end. The Cortinas patent features a paddle member hinged to the handle and manually actuated by the user moving a lever connected by a flexible member with the paddle to pivot the latter in a feces pick up action. The Tanahara patent features a cog wheel pivotally mounted to the depending end of the handle and actuated by a user lifting the lever pivoting the cog wheel to engage a rack moving a paddle toward a frame and bag in a scraping action.

Other United States patents such as U.S. Pat. No. 4,200,321 issued Apr. 29, 1980 to Warkentin; U.S. Pat. No. 4,102,547 issued Jul. 25, 1978 to Williams; U.S. Pat. No. 4,210,351 issued Jul. 1, 1980 to Orofino; U.S. Pat. No. 4,360,229 issued Nov. 23, 1982 to Kinney; and U.S. Pat. No. 5,269,575 issued Dec. 14, 1993 to Parvaresh, generally show the further state-of-the-art. Both Warkentin U.S. Pat. No. 4,200,321 and Orofino U.S. Pat. No. 4,210,351 disclose upright handles on a bag supporting frame with levers on the handle moved by the operator to pivot a scoop and move feces toward the frame bag, as in the Warkentin patent, or opposed members gripping the feces from opposing sides by a user operating a lever. Williams U.S. Pat. No. 4,102,547 and Kinney U.S. Pat. No. 4,360,229, disclose relatively small bag supporting containers, each having a handle member for moving or carrying the device in which Williams features a spring released trigger member which in turn releases a paddle member spring urged toward the opening of the container, when released by the thumb of the operator. The Kinney patent supports a bag with an open end position in which the user must bend over and scrape the feces into the bag, as by using a section of cardboard or the like. The remaining patent to Parvaresh U.S. Pat. No. 5,269,575, discloses a handle having a bag holding frame on its depending end in which the bag opening is disposed over the feces to be picked up or placed under the animal to be deposited as it falls into the bag.

The present invention is believed distinctive of all the above patents by providing a bag held in open position by a frame on the depending end of an upright telescoping handle. The frame supports a paddle for swinging movement through the frame and propelling dog feces into the bag by downward movement of the handle in the telescoping action.

BRIEF SUMMARY OF THE INVENTION

An upright forward and rearwardly open support frame vertically supports a telescoping handle. A bag frame, removably supporting a receptacle, such as a bag or container, projects rearwardly from the support frame and maintains the receptacle opening in confronting relation with the frame opening and in adjustable spaced relation with respect to the vertical plane of the frame.

The inner telescoping portion of the handle is connected with a vertically reciprocable inner frame member supporting a panel sweep member for vertical pivoting and swinging movement, by a cam action, through the frame opening about a horizontal axis of substantially 180° by vertical telescoping movement of the handle for propelling articles, disposed between the base frame and the receptacle, into the receptacle.

The principal object is to provide an apparatus which is manually actuated by vertical reciprocation of its telescoping handle when positioned with its frame opening adjacent animal feces for propelling the feces, or other articles, into a receptacle by vertical pivoting movement of the panel sweep member.

DETAILED DESCRIPTION OF THE INVENTION

Figures 1, 2, 3:
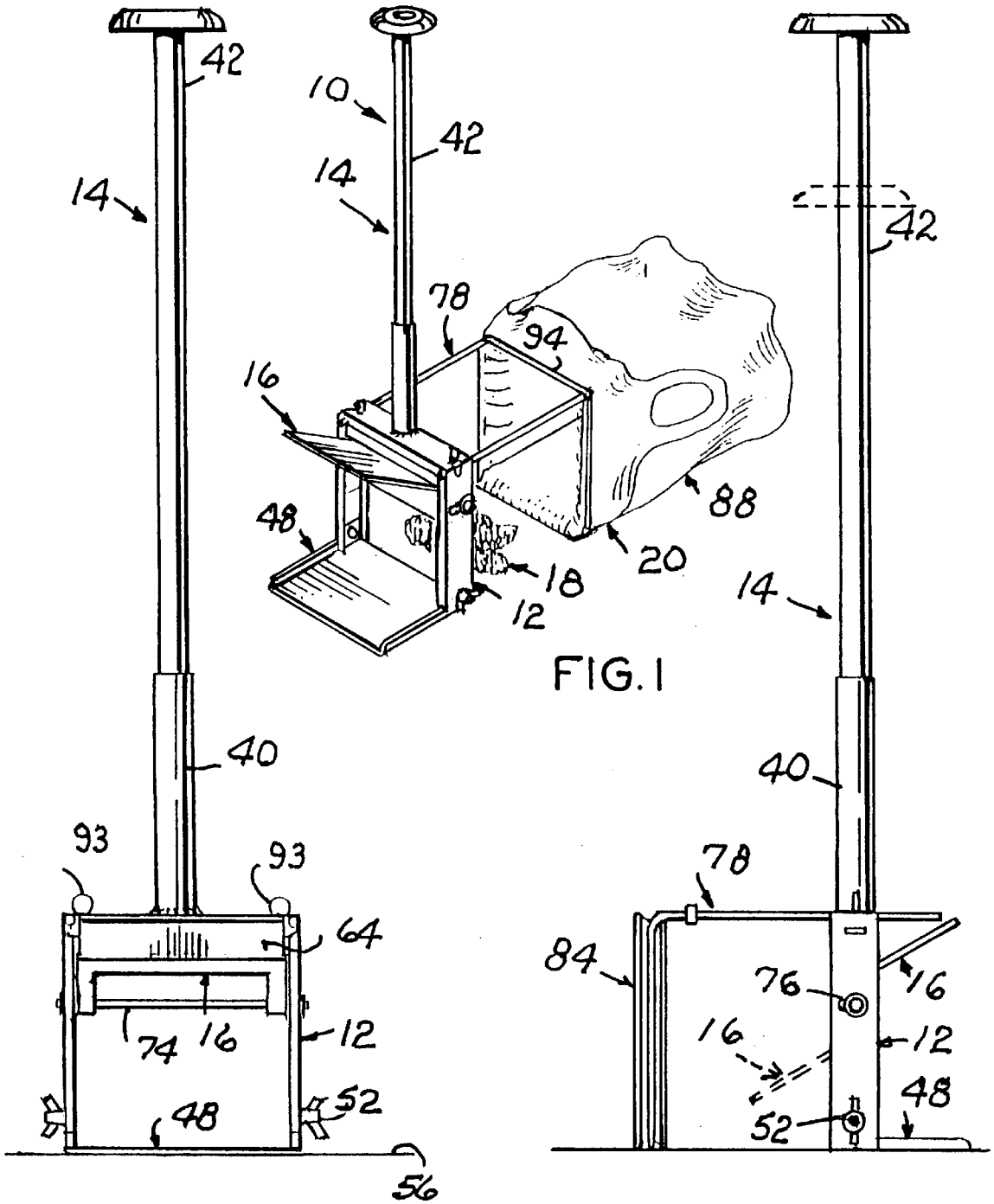
FIG. 1 is a perspective view of one embodiment of the device in operative position.
FIG. 2 is a side elevational view, to a larger scale, illustrating by dotted lines vertical reciprocating movement of operated components.
FIG. 3 is a rear elevational view of FIG. 2 with the receptacle removed.
Figures 4, 5, 6:
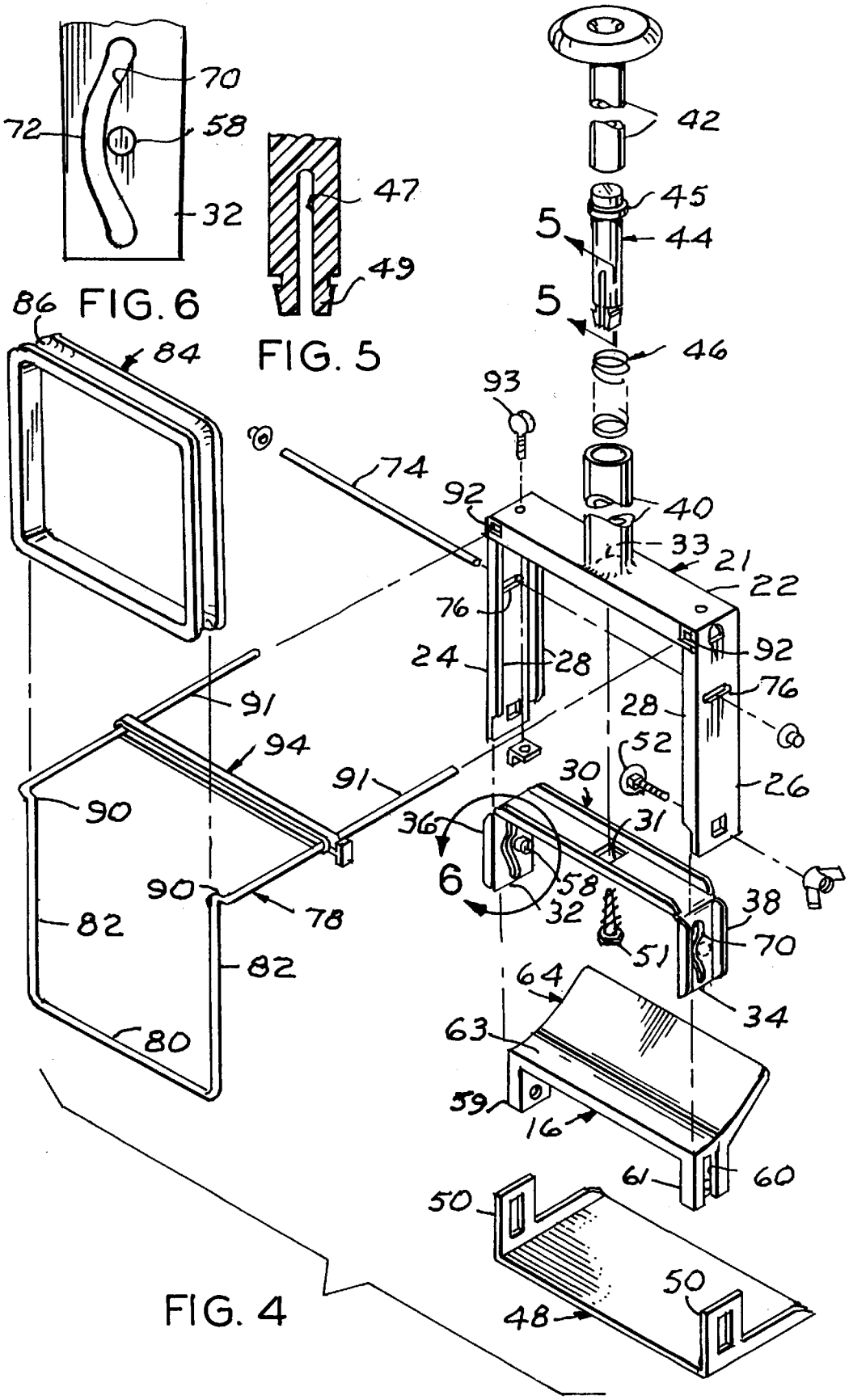
FIG. 4 is a fragmentary exploded perspective view of the device.
FIG. 5 is a fragmentary cross section view to a larger scale, taken substantially along the line 5—5 of FIG. 4.
FIG. 6 is an elevational view to a larger scale, of the area enclosed by the arrows 6.

Like characters of reference designate like parts in those figures of the drawings in which they occur.

In the drawings:

Referring first to FIGS. 1–6 the reference numeral 10 indicates one embodiment of the device, as a whole, comprising an upright forward and rearwardly open channel outer frame means 12 which supports a vertically telescoping handle means 14 in turn vertically reciprocating a panel sweep means 16 for propelling animal feces 18, or other articles into an open receptacle means 20, which may be a conventional plastic sack, when the handle means is telescoped downward.

The frame means 12 includes an outer inverted U-shaped support frame 21 having a bight portion 22 and depending legs 24 and 26 provided with inwardly turned flange edges 28 for vertically slidably receiving an inverted U-shaped inner frame means 30 having a square aperture 31 medially the ends of its bight portion and depending stub legs 32 and 34 cooperatively received between the inner surface of the outer frame legs 24 and 26. The inner frame means stub legs are similarly provided with flange edges 36 and 38 which are nested between the respective outer frame flanges 28 during reciprocating movement of the inner frame means, as will now be described.

The handle means 14 comprises an upright tubular base member 40 rigidly connected as by welding, at its depending end portion with the outer frame bight member 22, medially its length, in axial alignment with an aperture 33 formed therein. The handle means further includes an elongated tubular handle 42 having its depending end portion slidably received within the upper end portion of the tube 40 and axially connected with a spring guide 44 having an annular stop 45 adjacent its uppermost end. The depending end portion of the spring guide 44 is bifurcated as at 47, and provided with converging surfaces 49 for entering the bight portion aperture 31 of the inner frame 30. A screw 51 inserted into the slot 47 rigidly secures the spring guide 44 to the inner frame 30. A resilient member, such as helical spring 46, surrounds the spring guide 44 and abuts the stop 45 at its uppermost end and the top surface of the outer frame means 21 bight portion 22 at its depending end for normally biasing the handle member 42 in a telescopic extended direction.

The frame means 12 further includes a planar base plate 48 having upstanding vertically slotted relatively short legs 50 which are slidably received by the inner surface of the respective outer frame means legs 24 and 26 and are secured to the depending end portion of the outer frame legs by bolt and nut means 52. The base plate 48 is transversely widened in a rearward direction opposite the base legs 50 for supporting the apparatus 10 on a planar surface such as the earth 56 (FIG. 3).

A pair of stub axles 58, only one being shown, project inward in confronting axial alignment from the central portion of each leg 32 and 34 of the inner frame means 30. The stub axles 58 are longitudinally slidably received in downwardly open grooves 60, only one being shown, formed in the outer surface of each leg 59 and 61 of the inverted U-shaped sweep means 16 having a planar bight portion 63. A generally rectangular panel 64 forming the sweep portion of the sweep means 16, is integrally connected by one marginal side to the bight portion 63.

The legs 32 and 34 of the inner frame means 30 are centrally provided with through cam slots 70 each having respective end portions substantially vertically aligned and disposed on opposite sides of the respective stub axle 58 with an intermediate portion 72 of the slots arcuately bowed in a rearward direction around the position of the respective stub axle 58. The purpose of the slots 70 is to form a cam surface for guiding the respective end portions of an elongated axle 74, extending at respective end portions through the respective cam slot 70 and apertures in the depending end portion of the sweep means legs 59 and 61, and in transverse slots 76 in the respective leg 24 and 26 of the outer frame means 21. The horizontal slot 76 permits the axle 74 to move forwardly and rearwardly relative to the outer frame legs 24 and 26 when the inner frame and cam slots 70 are moved downwardly relative to the axle 74 during downward telescoping movement of the handle 42 which vertically pivots the panel sweep means 16 substantially 180° about the horizontal axis of the stub shafts 58.

One embodiment of the container means 20 comprises a wire-like bracket member 78 having a U-shaped end portion comprising a bight portion 80 and upstanding legs 82 forming a three sided socket for receiving three sides of an endless container support 84 having a peripheral groove 86 for nesting the bight portion 80 and vertical legs 82 of the bracket member U-shape and impinging open end edge portions of a flexible bag 88 between the wire-like bracket member and the groove 86. The open end portion of the bag 88 is extended through the endless container support 84 and doubled back upon itself before inserting the support 84 into the bracket 78. The bracket member legs 82 are bent at right angles intermediate their ends, as at 90, forming legs 91 extending horizontally parallel and forwardly toward opposing top end portions of the outer frame means 21 for respectively entering apertures 92 therein and are locked by a pair of set screws 93. An endless resilient member 94 on the horizontal legs 91 is manually moved to impinge the bag doubled back end portion overlying the support 84 opposite the bight portion 80 as illustrated by FIG. 1.

OPERATION

In the operation of the embodiment of FIGS. 1–6 the apparatus 10 is positioned, as illustrated by FIG. 1, relative to feces or other articles 18 to be bagged. The handle member 42 is manually telescoped into the tube 40 which forces the spring guide 44 downward and moves the inner frame 30 downwardly within the outer frame 21, vertically pivoting the sweep means 16 through the frame means end openings and propels the articles 18 into the receptacle 88. Release of manual pressure on the handle member 42 permits the spring 46 to telescopically extend the handle member 42 relative to the tube 40 and return the sweep means 16 to the position illustrated by FIGS. 1–3. When all the articles 18 have been picked up, or the container 88 filled, the container is removed from the bracket 78 and placed in a trash receiving receptacle, not shown. A clean empty receptacle 88 is then attached to the bracket 78 as described hereinabove, thus completing one cycle of operation.

Figure 9:
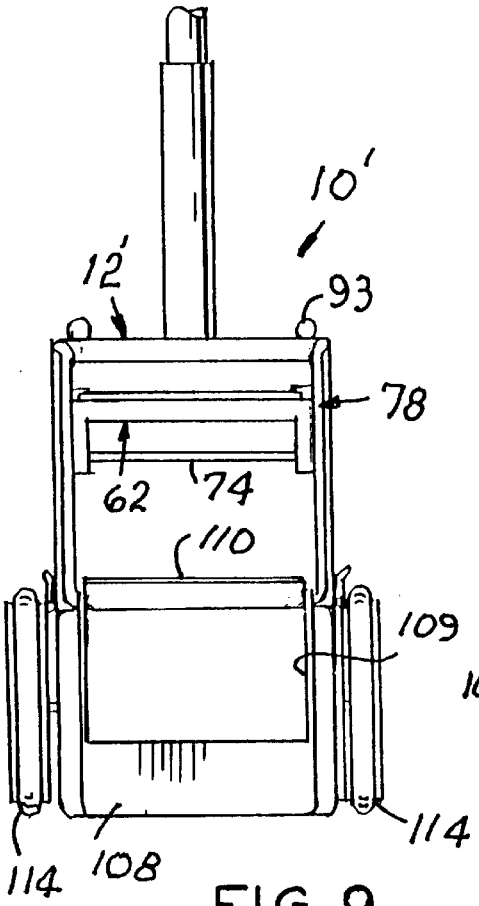
Figure 8:
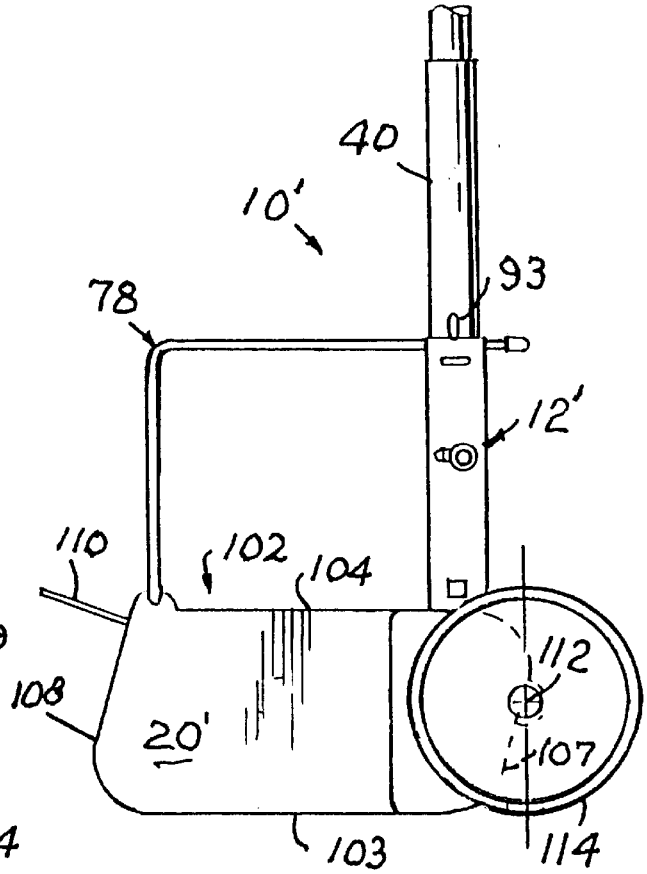
FIG. 8 is a side elevational view, similar to FIG. 7, with the receptacle folded for transport; and, FIG. 9 is a rear elevational view of FIG. 8.
Figure 7:
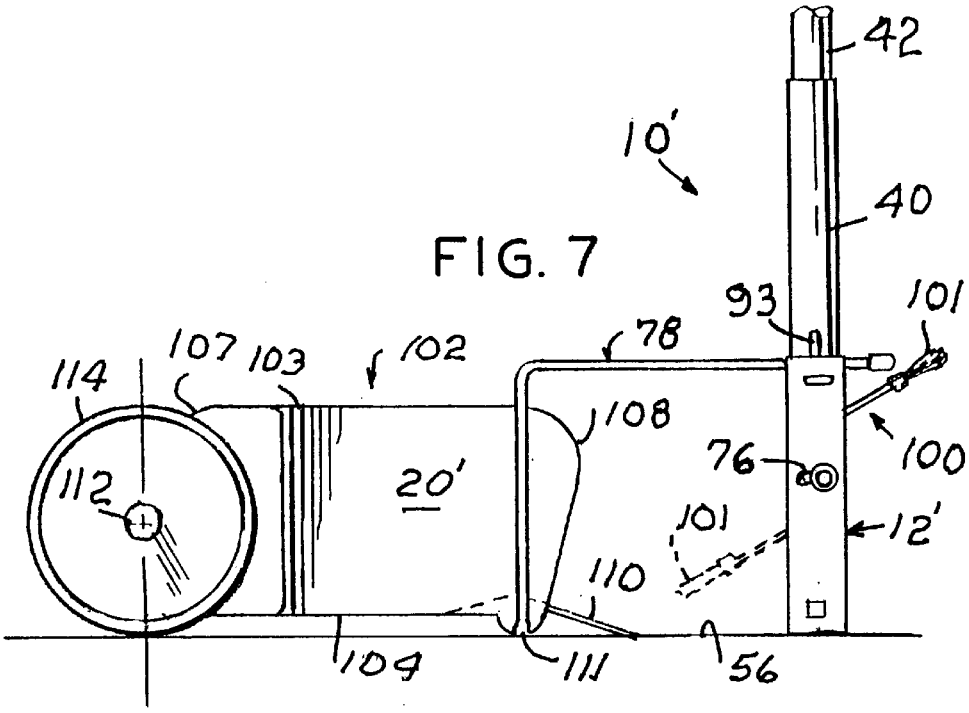
FIG. 7 is a side elevational view, similar to FIG. 2, of another embodiment.

Referring also to the remaining FIGS. 7, 8 and 9 wherein prime numerals indicate modified parts or assemblies.

The reference numeral 10' indicates another embodiment in which the assembled frames and telescoping handle members are substantially identical with respect to the embodiment 10 except as hereinafter noted. The frame means 12' is modified by omitting the base plate member 48. The container means 20' comprises a generally rectangular container 102 having a top 103; a bottom 104; opposing sides; one closed rearward end wall 107; and, a forward end 108 having an opening 109. A ramp 110 is inclined downwardly from the end 108 toward the surface of the earth 56 for guiding articles into the container (FIG. 7). Adjacent its forward end wall 108 the bottom wall 104 is provided with a transverse recess 111 which receives and pivotally supports the bight portion 80 of the wire frame member 78 permitting vertical pivoting movement of the container 102 about the horizontal axis of the bight portion 80 as presently explained.

The container end wall 107 supports a transverse axle 112 which journals a pair of wheels 114 at its respective end portions adjacent opposite sides of the container. The purpose of the wheels 114 is to move the device 10' across the surface of the earth in a two wheel dolly fashion, accomplished by tilting the handle member 14 to the right, as viewed in FIG. 8. The panel sweep rectangular portion panel 64 is replaced by a brush member 100 similarly secured to the sweep support bight portion 63. The brush member 100 is characterized by paint brush-like bristles 101 which contact articles and/or the surface being cleaned and sweep articles or debris through the open frame means 12' and deposit the same within the container 102 through its opening 109.

OPERATION OF EMBODIMENT OF FIGS. 7–9

With the device 10' in the position of FIG. 8, the device can be moved from location to location in a two wheel dolly fashion as explained hereinabove. When it is desired to pick up articles with the device 10', the handle and frame means are manually lifted and moved to the right, as viewed in FIG. 8, thus pivoting the container means 102 about the axis of the bracket member bight portion 80 to dispose the container means 102 in the position illustrated by FIG. 7 wherein its opening 109 is in confronting relation with the opening of the frame means 12' and the brush members 100 when the latter are disposed in the dotted line position of FIG. 7. Thereafter, the operation of the device 10' is substantially identical with the above described operation of the embodiment 10 during the article pickup or cleaning action. An exception is that the brush members 100 pick up smaller articles than is possible with the paddle or planar member 64. After picking up articles, the container means 102 may be emptied by removing it from the bight portion 80 or manually pivoting the wheel equipped end portion of the container 102 upwardly so that its opening 109 is disposed downwardly over a suitable trash receiving receptacle, not shown.

The device 10' may be repositioned, as illustrated by FIGS. 8 and 9, by manually lifting the handle and frame means in an upward direction, as viewed in FIGS. 7–9, to pivot the container about the axis of the bracket bight portion 80 in its groove 111 to dispose the container wall 103 downwardly, as illustrated by FIG. 8. The depending ends of the frame means 12' legs rest upon respective side edge portions of the container bottom wall 104.

Obviously, the invention is susceptible to changes or alterations without defeating its practicability. Therefore, I do not wish to be confined to the preferred embodiment(s) shown in the drawing(s) and described herein.

I claim:

1. A sanitation device for collecting and disposing of animal waste and the like, comprising;

outer frame means having a top, base plate, opposing ends and side members for forming a passageway through the frame ends;

inverted U-shape inner frame means having an apertured bight portion and stub legs slidably received by said side members;

sweep means pivotally supported by said inner frame means for vertical swinging movement about a horizonal axis through said passageway;

telescoping handle means connected with said outer frame means top and said inner frame means bight portion for pivoting said sweep means;

bracket means connected with one end of said outer frame means for supporting a receptacle adjacent said one end of the outer frame means; and, a receptacle having an open end removably supported by said bracket means.

2. The sanitation device according to claim 1 and further including;

a pair of stub axles axially secured in confronting relation to the inner surfaces of said stub legs, said stub legs each having a longitudinal cam slot adjacent and extending beyond the respective stub axle.

3. The sanitation device according to claim 2 in which said sweep means includes:

an inverted U-shaped member having a bight portion secured to a laterally extending panel and having depending relatively short parallel legs provided with a downwardly open end slot respectively slidably receiving the respective stub axle and having an aperture in the depending end portion of each leg.

4. The sanitation device according to claim 3 and further including:

said outer frame side members having a transverse slot adjacent the end portion opposite said base plate;

an axle projecting through said side member slots, the inner frame means cam slots and the sweep means leg apertures for journaling the sweep means in a to-and-fro swinging movement through the passageway.

5. The sanitation device according to claim 4 in which the handle means further includes:

a tubular base;

a tubular handle having a depending end portion slidably received by the base;

a spring guide depending from the handle and having a bifurcated and converging outer surface depending end portion frictionally received by the inner frame means bight portion aperture.

6. The sanitation device according to claim 1 in which the handle means further includes:

a tubular base;

a tubular handle having a depending end portion slidably received by the base;

a spring guide depending from the handle and having a bifurcated and converging outer surface depending end portion frictionally received by the inner frame means bight portion aperture.

7. A sanitation device for collecting and disposing of animal waste and the like, comprising;

outer frame means having a top, base plate, opposing ends and side members for forming a passageway through the frame ends;

inverted U-shape inner frame means having an apertured bight portion and stub legs having axially aligned stub axles and being slidably received by said side members;

sweep means pivotally supported by said inner frame means for vertical swinging movement, about the horizonal axis of said stub axles, through said passageway;

telescoping handle means connected with said outer frame means top and said inner frame means bight portion for vertically reciprocating said inner frame means and pivoting said sweep means;

bracket means connected with one end of said outer frame means for supporting a receptacle adjacent said one end of the outer frame means; and, receptacle means having an open end supported in confronting relation with the passageway by said bracket means.

8. The sanitation device according to claim 7 in which the inner frame means further includes:

said stub legs each having a longitudinal cam slot adjacent and extending beyond the respective stub axle.

9. The sanitation device according to claim 8 in which said sweep means includes:

an inverted U-shaped member having a bight portion secured to a laterally extending panel and having depending relatively short parallel legs provided with a downwardly open end slot respectively slidably receiving the respective stub axle and having an aperture in the depending end portion of each leg.

10. The sanitation device according to claim 9 and further including:

said outer frame side members having a transverse slot adjacent the end portion opposite said base plate;

an axle projecting through said side member slots, the inner frame means cam slots and the sweep means leg apertures for journaling the sweep means in swinging movement through the passageway.

11. The sanitation device according to claim 10 in which the handle means further includes:

a tubular base;

a tubular handle having a depending end portion slidably received by the base;

a spring guide depending from the handle and having a bifurcated and converging outer surface depending end portion frictionally received by the inner frame means bight portion aperture.

12. The sanitation device according to claim 7 in which the handle means further includes:

a tubular base;

a tubular handle having a depending end portion slidably received by the base;

a spring guide depending from the handle and having a bifurcated and converging outer surface depending end portion frictionally received by the inner frame means bight portion aperture.

13. The sanitation device according to claim 7 in which the sweep means includes:

a brush member.

14. The sanitation device according to claim 7 in which the sweep means includes:

a brush having brush bristles.

* * * * *